United States Patent [19]

Miyagawa et al.

[11] Patent Number: 5,048,232

[45] Date of Patent: Sep. 17, 1991

[54] SLIDER FOR DOOR WINDOWS OF VEHICLES AND METHODS OF MANUFACTURING THE SAME

[75] Inventors: Tokio Miyagawa, Yokohama; Yasukazu Nomura, Nirasaki; Tsuji Hitoshi, Utsunomiya, all of Japan

[73] Assignee: Mitsui Kinzoku Kogya Kabushiki Kaisha, Tokyo, Japan

[21] Appl. No.: 553,293

[22] Filed: Jul. 17, 1990

[30] Foreign Application Priority Data

Jul. 22, 1989 [JP] Japan ..... 1-189678

[51] Int. Cl.[5] ..... E05D 15/16; E05F 11/38

[52] U.S. Cl. ..... 49/440; 49/374; 49/404

[58] Field of Search ..... 49/440, 374, 375, 376, 49/502, 227, 348, 404, 428, 431, 433; 16/93 R

[56] References Cited

U.S. PATENT DOCUMENTS

| | | | |
|---|---|---|---|
| 4,483,100 | 11/1984 | Blankenburg et al. | 49/374 X |
| 4,494,337 | 1/1985 | Watanabe et al. | 49/374 |
| 4,503,639 | 3/1985 | Rossie et al. | 49/227 X |
| 4,611,435 | 9/1986 | Warner | 49/440 X |
| 4,631,865 | 12/1986 | Motonami et al. | 49/440 X |

*Primary Examiner*—Philip C. Kannan

*Attorney, Agent, or Firm*—Browdy and Neimark

[57] ABSTRACT

A slider for door windows of vehicles, comprising: a metal slide base comprising a base frame fixed to a door window glass, a sub-frame parallel with said base frame spaced by a predetermined distance from the base frame and having at least one mounting member, a side frame connecting end portions of the base frame the sub-frame; and slide pieces of a synthetic resin which are molded on the mounting members by using metal molds arranged with reference to the base frame, and which are slidably engaged with a guide fail fixed to the inner portion of a door.

1 Claim, 2 Drawing Sheets

SLIDER FOR DOOR WINDOWS OF VEHICLES AND METHODS OF MANUFACTURING THE SAME

FIELD OF THE INVENTION

This invention relates to a slider for door windows of vehicles and a method of manufacturing the same. This slider is engaged slidably with front and rear guide rails fixed to the inner portions of a door so as to guide the vertical movement of the door window.

BACKGROUND OF THE INVENTION

A known slider for door windows of vehicles comprises a metal slide base A having a base frame D fixed to a window glass B of a door through rubber packings C, a sub-frame E parallel with the base frame D and spaced by a predetermined distance L from the same, and a side frame F connecting these frames D, E; and a slide piece I fixed to the sub-frame E with pins G, engaged slidably with a guide rail H fixed inside the door, and formed of synthetic resin or the like, as shown in FIG. 6.

In this known slider, the pins G are made of metal. Therefore, when the end portions of the pins G project from the outer surface of the slide piece I, they would interfere with the inner surface of the guide rail H to cause an abnormality. Therefore, it is necessary that the operation of inserting the pins G into the slide piece I must be carried out very much carefully.

In general, four slide bases A are attached to one sheet of window glass, and two slide pieces I to each slide base A. Accordingly, in the case of a four-door car, 16 slide bases A and 32 slide pieces I are required in all. This means that not less than 8 types of slide bases A and not less than 16 types of slide pieces I must be prepared. Consequently, it is important to prevent these parts from being improperly assembled, and the complicated management of such parts is necessary.

In each of these slide bases A, the distance L between the base frame A and sub-frame D must be accurately set. If this distance is set improperly, the positional relation between the window B and guide rail H varies to hamper the smooth vertical movement of the window glass.

SUMMARY OF THE INVENTION

Therefore, an object of the present invention is to provide a method of manufacturing sliders for door windows of vehicles, capable of overcoming the above-mentioned problems at once.

Another object of the present invention is to provide a slider for door windows of vehicles, which overcomes the above-mentioned problems.

DESCRIPTION OF THE PREFERRED EMBODIMENT

Figure 1:
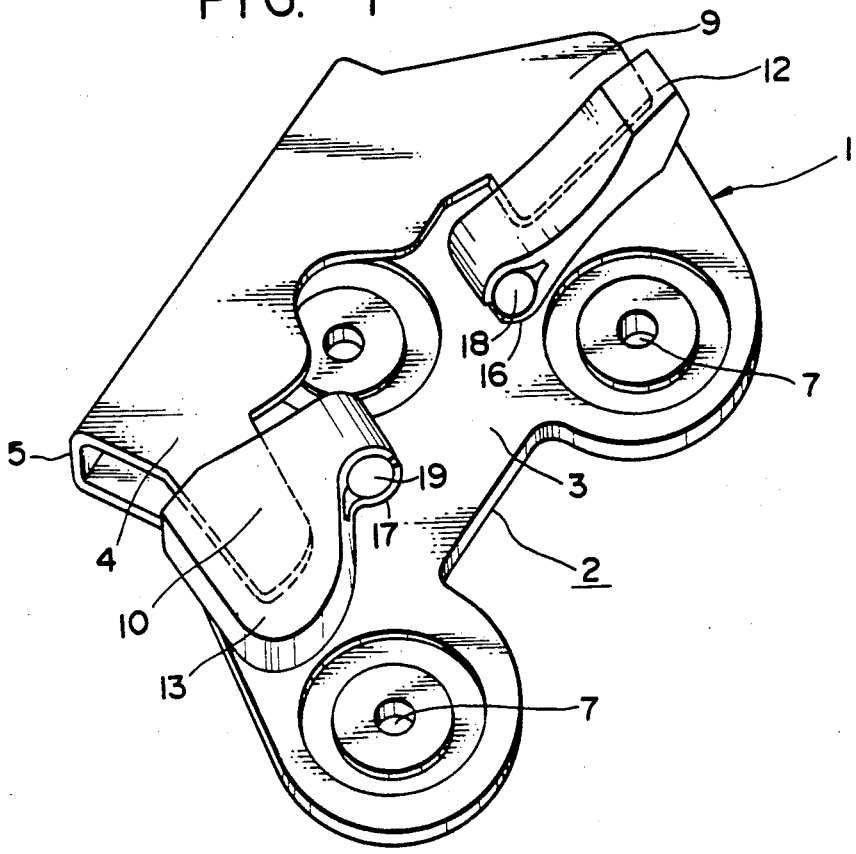
FIG. 1 is a eprspective view of a slider according to the present invention.
Figure 2:
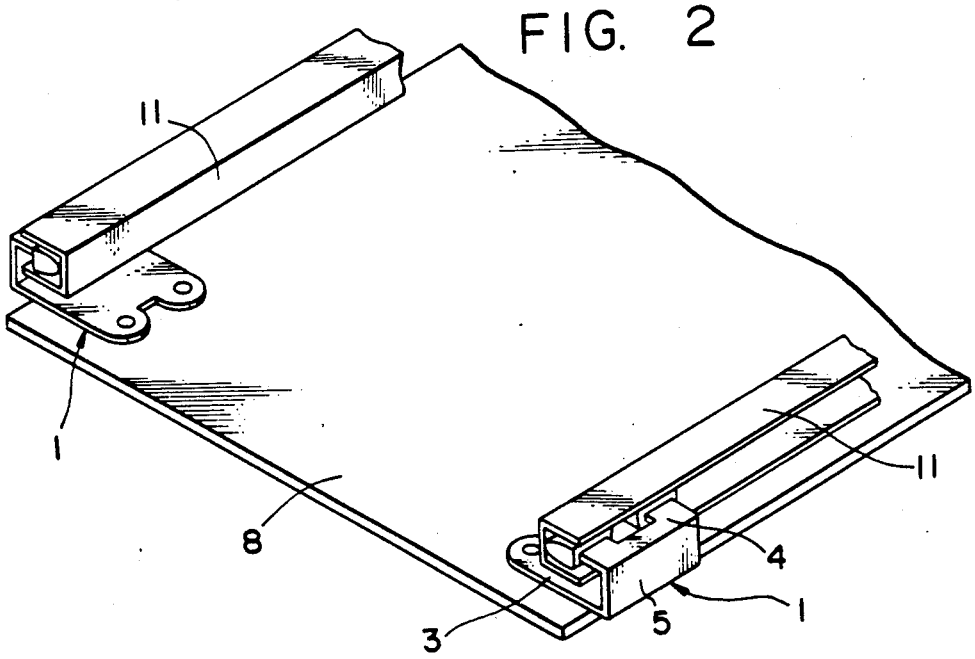
FIG. 2 is a perspective view of a slider fixed to a window glass.

An embodiment of the present invention will now be described with reference to the drawings. A slide base 2 of a slider 1 has a generally planar base frame 3, a sub-frame 4 parallel with the frame 3 and spaced by a predetermined distance X from the frame 3, and a side frame 5 connecting the end portions of these frames 3, 4 together. The parallelism of the frames 3 and 4 and the interval X between them may have errors to some extent (the accuracy of the parallelism and distance X may be around two times as low as that required in conventional sliders of this kind).

The base frame 3 is provided with a plurality of contact surfaces 6 projecting outward slightly, and a through hole 7 is made in the center of each of the contact surfaces 6. The slide base 2 is superposed at the contact surfaces 6 on the window glass 8 through rubber packings, and then fixed thereto by inserting set screws into these through holes 7.

Figure 3:
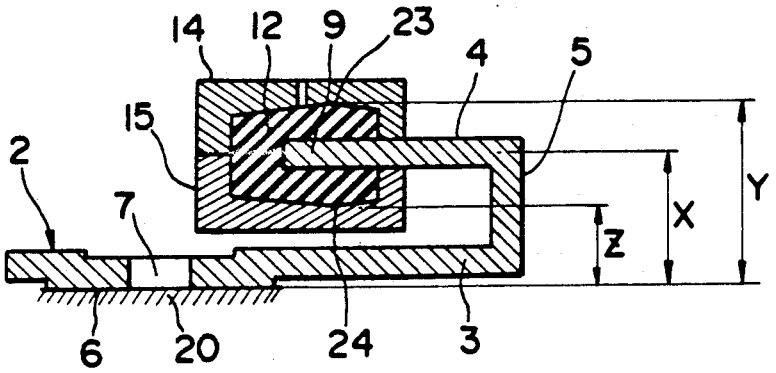
FIG. 3 is a veiw illustrating arrangement of metal molds for a slide base and a slide piece.
Figure 4:
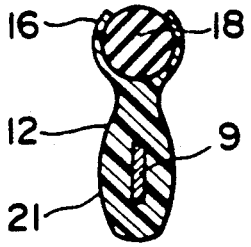
FIGS. 4 and 5 are sectional views of the slide pieces.
Figure 5:
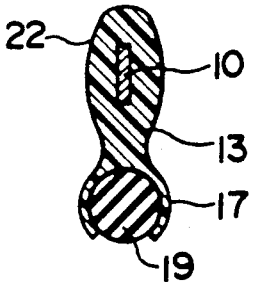
Figure 6:
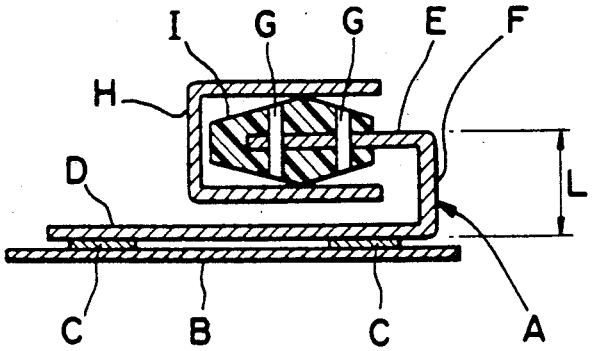
FIG. 6 (PRIOR ART)
FIG. 6 illustrates a known example of the slider of this kind.

The sub-frame 4 is provided with a pair of mounting members 9, 10, to which slide pieces 12, 13 of a synthetic resin slidable in a guide rail 11 fixed to the inner portion of a door are fitted. These slide pieces 12, 13 are molded on the mounting pieces 9, 10 by using upper and lower metal molds 14, 15 as shown in FIG. 3. Accordingly, the operation of mounting the slide pieces 12, 13 on the mounting members 9, 10 is unnecessary. The slide pieces 12, 13 are provided at their inner end sections with bifurcated portions 16, 17 in which rubber rods 18, 19 are inserted to elastically expand the bifurcated portions. These bifurcated portions 16, 17 are moved slidingly in the guide rail 11. The outer diameter of the cylindrical bifurcated portions 16, 17 are larger than the thickness of the base portions 21, 22.

A practical process for manufacturing this slider will now be described.

First, a slide base 2 is formed by drawing metal plate or by die casting aluminum alloy or zinc alloy. In the formation of this slide base 2, the parallelism of the base frame 2 and sub-frame 4 may and the interval therebetween have errors to some extent (the accuracy of the parallelism and distance X may be around two times as low as that required in conventional sliders of this kind).

The contact surfaces 6 of the base frame 3 are then fixed to a fixed rest 20 (or an insert die for a metal mold), and the mounting members 9, 10 are enclosed with the upper and lower metal molds 14, 15. At this time, the upper and lower metal molds 14, 15 are positioned with reference to the contact surfaces 6 or fixed rest 20 without regard to the position of the mounting members 9, 10. Namely, the lower surface 23 of the upper metal mold 14 and the contact surfaces 6 are spaced by the length Y, and the upper surface 24 of the lower metal mold 15 and the contact surfaces 6 with the length Z.

A synthetic resin is then injected into a cavity defined by the upper and lower metal molds 14, 15 positioned in this manner. The synthetic resin thus injected into the cavity is solidified in a predetermined shape in the metal molds and sticks to the outer circumferential surfaces of the mounting members 9, 10, becoming slide pieces 12, 13. The rubber rods 18, 19 are inserted between the bifurcated portions 16, 17 of the molded slide pieces 12, 13 to elastically expand the bifurcated portions.

Since the slide pieces 12, 13 thus produced are molded directly on the mounting members 9, 10, the metal setting pins become unnecessary, and an improper assembly of slide base 2 and slide pieces 12, 13 does not occur.

The slide pieces 12, 13 are kept in predetermined positions with respect to the contact surfaces 6, and molded in the upper and lower metal molds 14, 15. Therefore, even if there are some errors in the parallelism of the base frame 3 and sub-frame 4 and the distance X between them, the window glass 8 and guide rails 11 are held in predetermined relative positions, and the window 8 can be moved up and down smoothly.

What is claimed is:

1. A slider for door windows of vehicles, comprising a metal slide base comprising a base frame fixed to a door window glass, a sub-frame parallel with said base frame spaced at a predetermined distance from the base frame and having at least one mounting member, a side frame connecting end portions of the base frame the sub-frame; and slide pieces of a synthetic resin having at their inner end sections bifurcated portions with inserted rubber rods molded on said mounting members by using metal molds arranged with reference to said base frame; said bifurcated portions being slidably engaged with a guide rail fixed to an inner portion of a door.

* * * * *